US006163505A

United States Patent [19]

Meier et al.

[11] Patent Number: 6,163,505

[45] Date of Patent: Dec. 19, 2000

[54] CONTACT MEMBER FOR AN ULTRASONIC TRANSDUCER

[75] Inventors: Johann Meier, Mertigen; Karl-Heinz Zoller, Donauworth; Thomas Handschiegel, Wolferstadt, all of Germany

[73] Assignee: ITT Manufacturing Enterprises, Inc., Wilmington, Del.

[21] Appl. No.: 09/214,547

[22] PCT Filed: Jun. 10, 1997

[86] PCT No.: PCT/EP97/03019

§ 371 Date: May 24, 1999

§ 102(e) Date: May 24, 1999

[87] PCT Pub. No.: WO98/00242

PCT Pub. Date: Jan. 8, 1998

[30] Foreign Application Priority Data

Jul. 1, 1996 [DE] Germany ..... 196 26 293

[51] Int. Cl.[7] ..... H04R 17/00; B06B 1/06; G10K 11/00

[52] U.S. Cl. ..... 367/165; 439/883

[58] Field of Search ..... 367/188, 99, 165, 367/173; 439/775, 883, 860

[56] References Cited

U.S. PATENT DOCUMENTS

| | | | |
|---|---|---|---|
| Re. 34,773 | 11/1994 | Dombrowski | 340/904 |
| 3,697,985 | 10/1972 | Faris et al. | 343/5 |
| 3,989,965 | 11/1976 | Smith et al. | 310/8.2 |
| 4,041,335 | 8/1977 | Nagata et al. | 310/321 |
| 4,162,111 | 7/1979 | Brown | 310/326 |
| 4,240,152 | 12/1980 | Duncan et al. | 367/108 |
| 4,417,480 | 11/1983 | Zacharias, Jr. | 73/861.18 |
| 4,450,430 | 5/1984 | Barishpolsky et al. | 340/904 |
| 4,467,313 | 8/1984 | Yoshino et al. | 340/903 |
| 4,626,850 | 12/1986 | Chey | 340/903 |
| 4,691,418 | 9/1987 | Ingle et al. | 29/25.35 |
| 4,797,673 | 1/1989 | Dombrowski | 340/904 |
| 4,803,670 | 2/1989 | Chen | 367/99 |
| 4,910,512 | 3/1990 | Riedel | 340/943 |
| 4,980,869 | 12/1990 | Forster et al. | 367/99 |
| 4,994,800 | 2/1991 | Milliken | 340/901 |
| 5,229,975 | 7/1993 | Truesdell et al. | 367/107 |
| 5,373,482 | 12/1994 | Gauthier | 367/99 |
| 5,394,292 | 2/1995 | Hayashida | 361/179 |
| 5,463,384 | 10/1995 | Juds | 340/903 |
| 5,844,471 | 12/1998 | Daniel | 340/436 |

FOREIGN PATENT DOCUMENTS

| | | |
|---|---|---|
| 2438057 | 3/1975 | Germany . |
| 2749987 | 5/1978 | Germany . |
| 3144440 | 8/1982 | Germany . |
| 3419256 | 12/1984 | Germany . |
| 3330411 | 3/1985 | Germany . |
| 3826799 | 2/1990 | Germany . |
| 4325028 | 2/1995 | Germany . |
| 60-114100 | 6/1985 | Japan . |
| 2128399 | 4/1984 | United Kingdom . |

OTHER PUBLICATIONS

Piezoelektrische Biegewandler der Fa., Dr. Lutz Pickelmann GmbH, Nov. 1994, S. 12,13.

*Primary Examiner*—Ian J. Lobo
*Attorney, Agent, or Firm*—J. Gordon Lewis

[57] ABSTRACT

The invention relates to an ultrasonic transducer with a pot-shaped oscillating element, which is mounted in a transducer housing and which bears a piezoelectric disc on its bottom. The invention simplifies the electric contact-making between the connecting leads and the oscillating element or the piezoelectric disc and makes this process more suitable for automated manufacturing. The invention consists of contact springs which are not soldered or caulked with the above-mentioned elements, but only tact them resiliently. Improvements are achieved through an essentially cylinder-shaped connecting element, to which the contact springs are fastened by casting and which can also serve as a damping element.

8 Claims, 2 Drawing Sheets

Fig. 1
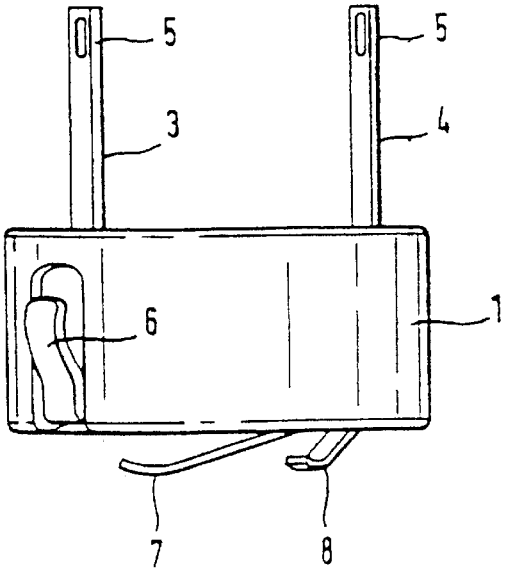
Fig. 2
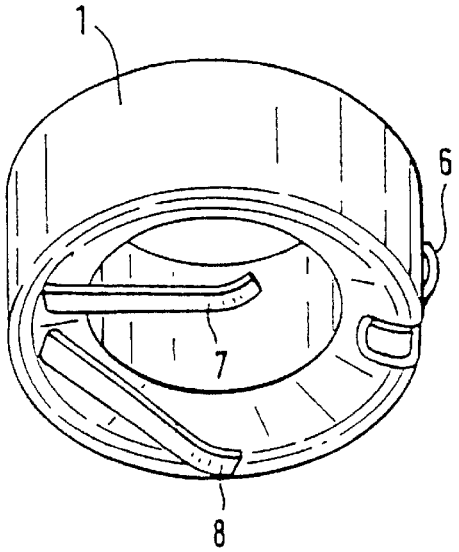
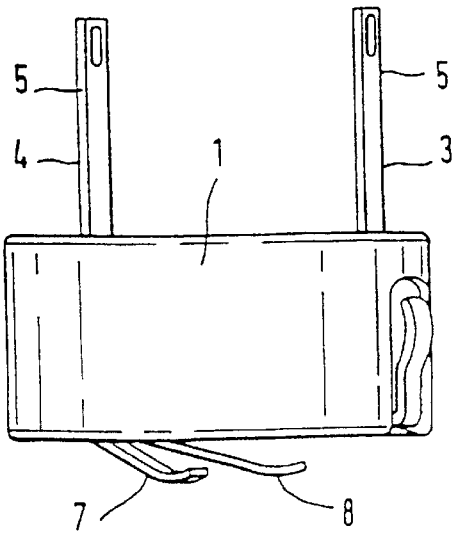
Fig. 3
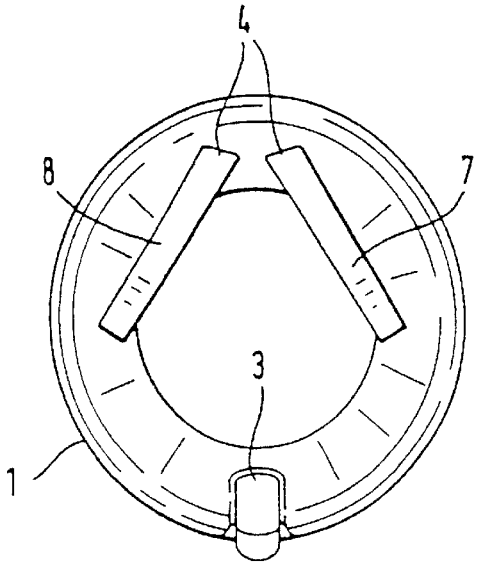
Fig. 4

CONTACT MEMBER FOR AN ULTRASONIC TRANSDUCER

BACKGROUND OF THE INVENTION

The present invention relates to an ultrasonic transducer, in particular, for distance warning/anti-collision devices in motor vehicles. These kinds of transducers have a piezoelectric disc that begins to oscillate when a voltage is applied. These oscillations are transmitted to an oscillating element, and it is known that at least one of the electrical connecting leads is taken to the piezoelectric disc via the oscillating element. This type of design, for example, is disclosed in the German patent application 196 01 656.8.

The transducers described above have the disadvantage that the electrical leads either have to be soldered directly to the piezoelectric element or are at least partially—run over the, preferably aluminum, oscillating element. This means that a permanent electrical connection has to be established between the supply lead and the oscillating element or the piezoelectric disc. In known solutions, the electrical lead is soldered directly to the piezoelectric disc or the lead is run into a groove on the aluminum oscillating element and caulked thereto. Both electrical connections can be critical and are not suitable for automated manufacturing. Another disadvantage is that the transducer normally is fitted with a damping element located above the disc in the oscillating element. Consequently, it also must be ensured that the electrical connecting leads are run through appropriate holes in the damping element, which further precludes a simple production process. In the known DE-OS 38 26 799, it already has been proposed to establish the connection by means of contact pins that can be joined with each other, in which case, however, the ends of the contact pins would also have to be permanently connected to the piezoelectrical crystal.

GB-OS 2 128 399 discloses an ultrasonic transducer, in which a printed circuit board is used as the electrical circuit. The printed circuit board itself has protruding resilient contact arms that come into biased contact with assigned contact points in the transducer. The contact arms are soldered to the printed circuit board and are led through the printed circuit board by way of assigned openings after the soldering process. In order to be able to align the printed circuit board within the pot-shaped transducer housing, it is held within a retaining bowl. As far as the contact making is concerned, this is a comparably complicated design.

SUMMARY OF THE INVENTION

The object of the present invention is to simplify the contacting of these kinds of transducers and their production in automated manufacturing processes. In principle the present invention consists of providing a special connecting element, to which the contact springs are fastened by casting and, hence, are given a firm hold. The invention allows numerous advantageous further embodiments, which are explained below.

This measure serves to guide the contact springs and to provide them with a firm hold in the oscillating element.

A simple mounting for the connecting element within the oscillating element is described wherein the outside form of the connecting element is such that it can be pressed into the interior space of the pot-shaped oscillating element and, consequently, is permanently anchored therein. In this way, the supports needed for the spring contacts—which are fastened by casting to the connecting element—are provided, so that the spring contacts can bear against the piezoelectric disc with considerable force and, hence, ensure good contact-making.

If the contact-making is to be improved and made safer, in a further embodiment of the present invention a good electrical connection between the spring contact and the piezoelectric disc or the oscillating element can be established, even when the contact-making properties of one of the first ends of the contact springs decrease. If the connecting element is to have only small volume, it should be ring-shaped. In a number of cases, it is recommended that the connecting element have the form of a solid cylinder. The contact-making between the concerned contact spring and the oscillating element can be improved when the middle section of the contact spring is located in the edge area of the connecting element and coaxial to it, so that only short distances need to be covered. Good contact to the inner lateral surface of the oscillating element is ensured by bending the contact located on the end of the connecting element that faces the piezoelectric disc back until it is U-shaped, so that the protruding first end can contact the electrically conductive inner lateral surface of the oscillating element over a longer area.

A special advantage can be achieved by using the connecting element as a damping element at one and the same time, e.g., by producing it of a suitable vibration-damping material.

BRIEF DESCRIPTION OF THE DRAWINGS

An embodiment of the invention is shown on the basis of the following drawings:

FIG. 1 is a side view of a first embodiment;

FIG. 2 is a perspective bottom view of the embodiment according to FIG. 1;

FIG. 3 shows the embodiment according to FIG. 1 turned to the side;

FIG. 4 shows FIG. 3 viewed directly from below;

DESCRIPTION OF THE PREFERRED EMBODIMENTS

Figure 5:
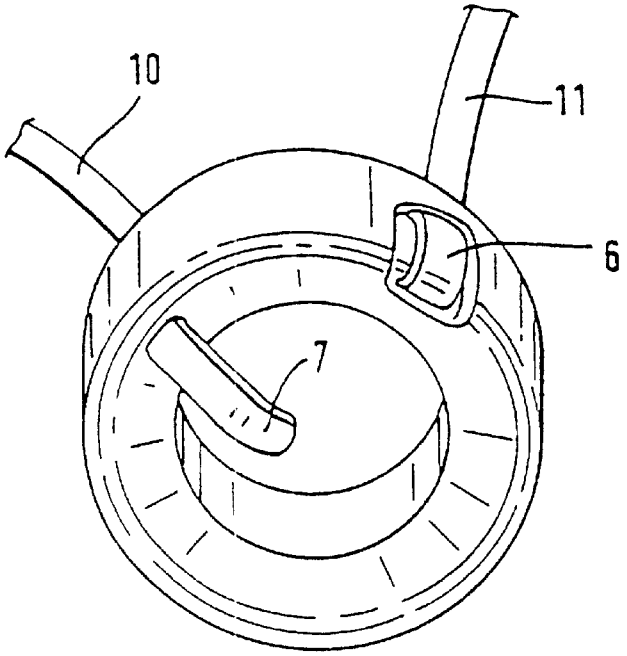
FIG. 5 is a perspective bottom view of a second embodiment.

FIGS. 1 to 4 show a ring-shaped connecting element 1 that can also be a solid body and preferably is made of damping material. Two contact springs 3, 4 are injected into the wall surface of the connecting element 1. The first ends 5 of the contact springs 3 and 4 are used to solder on connecting leads which are led from the transducer (not shown in the drawing). The free second end 6 of the contact spring 3 is bent to form a U-shape at the lower end of the ring and protrudes somewhat from the lateral surface of the connecting element 1. In this way, a resilient contact surface is obtained which bears against the inner lateral surface of the oscillating element (not shown) with good electrical contact, when such oscillating element is made of a conductive metal (aluminum). The free end of the contact spring 4 branches into the two free ends 7 and 8, which resiliently protrude at an angle to the bottom of the connecting element, so that they can bear against the bottom of the hollow-cylinder-shaped oscillating element with good contact and, in addition, exhibit good electrical contact-making properties.

Figure 6:
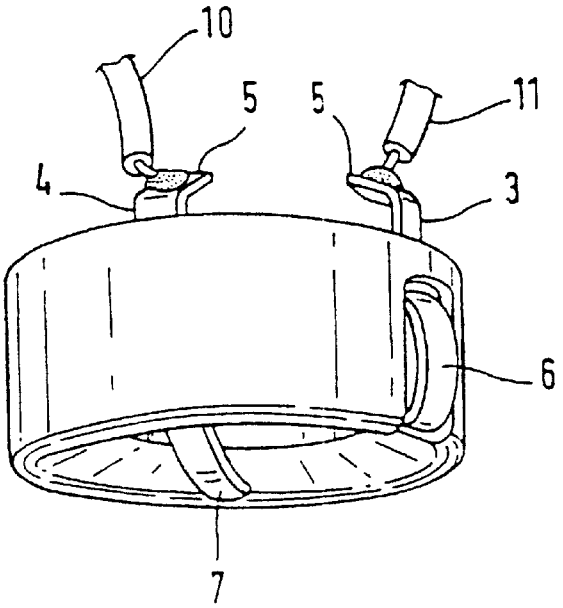
FIG. 6 is a perspective side view of the embodiment according to FIG. 5.

The embodiment according to FIGS. 5 and 6 is only described to the extent necessary to illustrate the differences to the first embodiment. FIGS. 5 and 6 show connecting leads 10 and 11 soldered to the first ends 5 of the contact springs 3 and 4. The contact spring 4 is not branched at its lower end, rather it has only one free second end 7. The free second end 6 of the contact spring 3 does not protrude freely from the groove in the lateral surface of the connecting element, rather its end is caught in the groove, so that the free end 6 arches out of the groove and its contours protrude over the lateral surface of the connecting element 1 to make contact with the oscillating element.

What is claimed is:

1. In an ultrasonic transducer with a housing that is fitted with a receptacle for a pot-shaped oscillating element, with such oscillating element exhibiting a circumferential lateral wall and bearing a piezoelectric disc on its bottom surface, which serves as a membrane, and with at least one of said piezoelectric disc and the oscillating element being fitted with contacts for electric connecting leads, with the contacts being formed by contact springs, wherein first ends of the contact springs are adapted to bear against at least one of the piezoelectric disc and the oscillating element and connecting leads are adapted to be connected to free second ends of the contact springs the improvement characterized in that the contact springs are fastened by casting to a cylinder-shaped connecting element from which first and second ends protrude.

2. The improvement according to claim 1, characterized in that the connecting element is adapted to be pressed into the oscillating element through frictional force in relation to an inner lateral surface of the oscillating element and, is held in position by the elastic force of the contacting ends of the contact springs.

3. The improvement according to claim 1, characterized in that the end adapted to bear against the piezoelectric disc branches into two free second ends.

4. The improvement according to claim 1, characterized in that the first free end assigned to the oscillating element is bent parallel to an inner lateral surface of the oscillating element.

5. The improvement according to claim 1, characterized in that the connecting element is ring-shaped and the contact springs essentially run coaxially within the connecting element.

6. The improvement according to claim 1, characterized in that the connecting element is designed as a damping element for the transducer.

7. The improvement according to claim 6, characterized in that the connecting element is formed of a damping material.

8. The improvement according to claim 1, characterized in that the end adapted to bear against the piezoelectric disc is formed by two free ends of two parallel contact springs.

* * * * *